US010600398B2

(12) United States Patent
Pachet et al.

(10) Patent No.: US 10,600,398 B2
(45) Date of Patent: Mar. 24, 2020

(54) DEVICE AND METHOD FOR GENERATING A REAL TIME MUSIC ACCOMPANIMENT FOR MULTI-MODAL MUSIC

(71) Applicant: SONY CORPORATION, Tokyo (JP)

(72) Inventors: Francois Pachet, Paris (FR); Pierre Roy, Paris (FR)

(73) Assignee: SONY CORPORATION, Tokyo (JP)

( * ) Notice: Subject to any disclaimer, the term of this patent is extended or adjusted under 35 U.S.C. 154(b) by 39 days.

(21) Appl. No.: 14/442,330

(22) PCT Filed: Dec. 5, 2013

(86) PCT No.: PCT/EP2013/075695

§ 371 (c)(1),
(2) Date: May 12, 2015

(87) PCT Pub. No.: WO2014/086935

PCT Pub. Date: Jun. 12, 2014

(65) Prior Publication Data

US 2016/0247496 A1 Aug. 25, 2016

(30) Foreign Application Priority Data

Dec. 5, 2012 (EP) ..... 12195673
Mar. 26, 2013 (EP) ..... 13161056

(51) Int. Cl.
*G10H 1/38* (2006.01)
*G10H 1/36* (2006.01)
(Continued)

(52) U.S. Cl.
CPC ..... *G10H 1/36* (2013.01); *G10H 1/18* (2013.01); *G10H 1/383* (2013.01); *G10H 1/40* (2013.01);
(Continued)

(58) Field of Classification Search
USPC ..... 84/612
See application file for complete search history.

(56) References Cited

U.S. PATENT DOCUMENTS 4,941,387 A 7/1990 Williams et al.
5,221,802 A * 6/1993 Konishi ..... G10H 1/383 84/613
(Continued)

FOREIGN PATENT DOCUMENTS

| | | |
|---|---|---|
| EP | 0 647 934 | 4/1995 |
| JP | 2011 215257 | 10/2011 |
| WO | 2011 094072 | 8/2011 |

OTHER PUBLICATIONS

Goto, M. , "A Robust Predominant-F0 Estimation Method for Real-Time Detection of Melody and Bass Lines in CD Recordings", Acoustics, Speech, and Signal Processing, 2000. ICASSP '00. Proceeding S. 2000 IEEE International Conference, vol. 2, (Jun. 5, 2000), XP10504833, pp. 757-760.
Jamey Abersold Jazz, "Jazz Handbook", (2010), (Total pp. 56).
RC-3 Loop Station Owner's Manual, Boss Corporation, (2011), (Total pp. 168).
Cherla, S., "Automatic Phrase Continuation from Guitar and Bass-guitar Melodies", Master's Thesis MTG-UPF / 2011, Universitat Pompeu Fabra, (2011), (Total pp. 77).
(Continued)

*Primary Examiner* — Christopher Uhlir
(74) *Attorney, Agent, or Firm* — Xsensus LLP

(57) ABSTRACT

A device for generating a real time music accompaniment includes a music input interface, a music mode classifier that classifies pieces of music received at the music input interface into one of different music modes including at least a solo mode, a bass mode, and a harmony mode, a music storage, and a music output interface. A music selector selects one or more recorded pieces of music as real time music accompaniment to an actually played piece of music received at the music input interface, wherein the one or more selected pieces of music are selected to be in a different music mode than the actually played piece of music. A music output interface outputs the selected pieces of music.

10 Claims, 10 Drawing Sheets

(51) Int. Cl.
*G10H 1/18* (2006.01)
*G10H 1/40* (2006.01)

(52) U.S. Cl.
CPC . *G10H 2210/005* (2013.01); *G10H 2210/031* (2013.01); *G10H 2210/056* (2013.01); *G10H 2210/391* (2013.01); *G10H 2250/641* (2013.01)

(56) References Cited

U.S. PATENT DOCUMENTS

| | | | | |
|---|---|---|---|---|
| 5,442,129 | A | 8/1995 | Mohrlok et al. | |
| 5,585,585 | A | 12/1996 | Paulson et al. | |
| 5,796,026 | A * | 8/1998 | Tohgi | G10H 1/36 84/609 |
| 7,355,111 | B2 * | 4/2008 | Ikeya | G10H 1/0041 84/604 |
| 2003/0076348 | A1 | 4/2003 | Najdenovski | |
| 2007/0261535 | A1 | 11/2007 | Sherwani et al. | |
| 2010/0288106 | A1 | 11/2010 | Sherwani et al. | |
| 2010/0307321 | A1 * | 12/2010 | Mann | G06F 3/0481 84/613 |
| 2011/0271187 | A1 | 11/2011 | Sullivan et al. | |
| 2012/0137855 | A1 * | 6/2012 | Gannon | G10H 1/0025 84/613 |

OTHER PUBLICATIONS

Hamanaka, M., et al., "A Learning-Based Jam Session System that Imitates a Player's Personality Model", International Joint Conference on Artificial Intelligence, (2003), (Total pp. 9).

Lahdeoja, O., "An Approach to Instrument Augmentation: the Electric Guitar", Proceedings of the 2008 Conference on New Interfaces for Musical Expression (NIME08), (2008), pp. 53-56.

Levy, B., et al., "OMaxist Dialectics: Capturing, Visualizing and Expanding Improvisations", NIME '12, (May 21-23, 2012), (Total pp. 4).

Peeters, G., "A large set of audio features for sound description (similarity and classification) in the CUIDADO project", (Apr. 23, 2004), (Total pp. 25).

Reboursiere, L., et al., "Multimodal Guitar: A Toolbox for Augmented Guitar Performances", Proceedings of the 2010 Conference on New Interfaces for Musical Expression (NIME 2010), (Jun. 15-18, 2010), pp. 415-418.

Schwarz, D., "Current Research in Concatenative Sound Synthesis", Proceedings of the International Computer Music Conference (ICMC), (Sep. 5-9, 2005), pp. 1-4.

Dannenberg, R. B., "An On-Line Algorithm for Real-Time Accompaniment", Proceedings of the 1984 International Computer Music Conference, (1985), pp. 193-198.

International Search Report dated Jun. 23, 2014 in PCT/EP2013/075695 Filed Dec. 5, 2013.

* cited by examiner $\sigma_1$: $C7 \rightarrow G\ min\ 7$ [1]

$\sigma_2$: $C7 \rightarrow C$ [1]

$\sigma_3$: $C7 \rightarrow F\sharp 7$ [2]

$\sigma_4$: $C7 \rightarrow C\sharp\ dim$ [1]

$\sigma_5$: $C7 \rightarrow E\ dim$ [1]

$\sigma_6$: $C7 \rightarrow G\ dim$ [1]

$\sigma_7$: $C7 \rightarrow B\flat\ dim$ [1]

$\sigma_8$: $C\ dim \rightarrow F\sharp\ dim$ [2]

$\sigma_9$: $C\ dim \rightarrow E\flat\ dim$ [1]

$\sigma_{10}$: $C\ dim \rightarrow G\ dim$ [1]

$\sigma_{11}$: $C\ dim \rightarrow B\flat\ dim$ [1]

$\sigma_{12}$: $C\ dim \rightarrow B7$ [1]

$\sigma_{13}$: $C \rightarrow C\ maj7$ [1]

$\sigma_{14}$: $C \rightarrow A\ min$ [1]

$\sigma_{15}$: $C \rightarrow A\ min\ 7$ [1]

$\sigma_{16}$: $C \rightarrow E\ min$ [1]

$\sigma_{17}$: $C \rightarrow E\ min\ 7$ [1]

$\sigma_{18}$: $C\ maj7 \rightarrow C$ [1]

$\sigma_{19}$: $C\ maj7 \rightarrow E\ min$ [1]

$\sigma_{20}$: $C\ maj7 \rightarrow A\ min$ [1]

$\sigma_{21}$: $C\ maj7 \rightarrow A\ min\ 7$ [1]

$\sigma_{22}$: $C\ min\ 7 \rightarrow C\ min$ [1]

$\sigma_{23}$: $C\ min\ 7 \rightarrow F7$ [1]

$\sigma_{24}$: $C\ min\ 7 \rightarrow E\flat$ [1]

$\sigma_{25}$: $C\ min\ 7 \rightarrow E\flat\ maj7$ [1]

$\sigma_{26}$: $C\ min\ 7 \rightarrow A\flat$ [1]

$\sigma_{27}$: $C\ min\ 7 \rightarrow A\flat\ maj7$ [1]

$\sigma_{28}$: $C\ min\ 7 \rightarrow A\emptyset$ [1]

$\sigma_{29}$: $C\ min \rightarrow F7$ [1]

$\sigma_{30}$: $C\ min \rightarrow E\flat\ maj7$ [1]

$\sigma_{31}$: $C\ min \rightarrow E\flat$ [1]

$\sigma_{32}$: $C\ min \rightarrow A\flat$ [1]

$\sigma_{33}$: $C\emptyset \rightarrow E\flat\ min\ 7$ [1]

Fig. 12

$\sigma_{1,1}$: $C7 \rightarrow G\ min\ 7$ $\sigma_{1,2}$: $C\sharp 7 \rightarrow G\sharp\ min\ 7$ $\sigma_{1,3}$: $D7 \rightarrow A\ min\ 7$ $\sigma_{1,4}$: $D\sharp 7 \rightarrow A\sharp\ min\ 7$ $\sigma_{1,5}$: $E7 \rightarrow B\ min\ 7$ $\sigma_{1,6}$: $F7 \rightarrow C\ min\ 7$ $\sigma_{1,7}$: $F\sharp 7 \rightarrow C\sharp\ min\ 7$ $\sigma_{1,8}$: $G7 \rightarrow D\ min\ 7$ $\sigma_{1,9}$: $G\sharp 7 \rightarrow D\sharp\ min\ 7$ $\sigma_{1,10}$: $A7 \rightarrow E\ min\ 7$ $\sigma_{1,11}$: $A\sharp 7 \rightarrow F\ min\ 7$ $\sigma_{1,12}$: $B7 \rightarrow F\sharp\ min\ 7$

Fig. 13

DEVICE AND METHOD FOR GENERATING A REAL TIME MUSIC ACCOMPANIMENT FOR MULTI-MODAL MUSIC

CROSS-REFERENCE TO RELATED APPLICATIONS

The present application claims priority to European Patent Application EP 12 195 673.4 filed in the European Patent Office on Dec. 5, 2012, and EP 13 161 056.0 filed in the European Patent Office on Mar. 26, 2013, the entire contents of each of which being incorporated herein by reference.

BACKGROUND

Field of the Disclosure

The present disclosure relates to a device and a corresponding method for generating a real time music accompaniment, in particular for playing multi-modal music, i.e. enable the playing of music in multiple modes. Further, the present disclosures relates to a device and a corresponding method for recording pieces of music for use in generating a real time music accompaniment. Still further, the present disclosure relates to a device and a corresponding method for generating a real time music accompaniment using a transformation of chords.

Description of Related Art

Known devices and methods for generating a real time music accompaniment make e.g. use of so-called "loop pedals" (also called "looping pedals"). Loop pedals are real-time samplers that playback audio played previously by a musician. Such pedals are routinely used for music practice or outdoor "busking", i.e. generally for generating a real time music accompaniment. However, the known loop pedals always play back the same material, which may make performances monotonous and boring both to the musician and the audience, thereby preventing their uptake in professional concerts.

Further, standard loop pedals often force the musician to play the entire loop once during a "feeding phase" before starting to improvise on top of it, i.e. while the loop will be repeated. This can be repetitive when the chord grid is to be played in a stylistically consistent manner (which is most of the time the case). Further, this can be a problem when the loop is played on top of a given chord sequence (or chord grid), because the musician cannot start improvising until the whole grid has been played. Another approach is to pre-record loops. This raises another issue as the audience will not know what is pre-recorded and what is actually performed by the musician. This is a general shortcoming of computer-assisted music performance The "background" description provided herein is for the purpose of generally presenting the context of the disclosure. Work of the presently named inventor(s), to the extent it is described in this background section, as well as aspects of the description which may not otherwise qualify as prior art at the time of filing, are neither expressly or impliedly admitted as prior art against the present disclosure.

SUMMARY

It is an object to provide a device and a corresponding method for generating an improved real time music accompaniment. It is a further object to provide a device and a corresponding method for recording pieces of music for use in generating a real time music accompaniment. It is still a further object to provide a corresponding computer program for implementing said methods and a non-transitory computer-readable recording medium.

According to an aspect there is provided a device for generating a real time music accompaniment, said device comprising

- a music input interface that receives pieces of music played by a musician,
- a music mode classifier that classifies pieces of music received at said music input interface into one of different music modes including at least a solo mode, a bass mode and a harmony mode,
- a music selector that selects one or more recorded pieces of music as real time music accompaniment to an actually played piece of music received at said music input interface, wherein said one or more selected pieces of music are selected to be in a different music mode than the actually played piece of music, and
- a music output interface that outputs the selected pieces of music.

According to a further aspect there is provided a corresponding method for generating a real time music accompaniment, said method comprising

- receiving pieces of music played by a musician,
- classifying received pieces of music into one of different music modes including at least a solo mode, a bass mode and a harmony mode,
- selecting one or more recorded pieces of music as real time music accompaniment to an actually played piece of music, wherein said one or more selected pieces of music are selected to be in a different music mode than the actually played piece of music.
- outputting the selected pieces of music.

According to a further aspect there is provided a device for recording pieces of music for use in generating a real time music accompaniment, said device comprising

- a music input interface that receives pieces of music played by a musician,
- a music mode classifier that classifies pieces of music received at said music input interface into one of different music modes including at least a solo mode, a bass mode and a harmony mode,
- a recorder that recording pieces of music received at said music input interface along with the classified music mode.

According to a further aspect there is provided a corresponding method for recording pieces of music for use in generating a real time music accompaniment, said method comprising

- receiving pieces of music played by a musician,
- classifying received pieces of music into one of different music modes including at least a solo mode, a bass mode and a harmony mode,
- recording received pieces of music along with the classified music mode.

According to still another aspect there is provided a device for generating a real time music accompaniment, said device comprising

- a chord interface that is configured to receive a chord grid comprising a plurality of chords,
- a music interface that is configured to receive at least one chord of a chord grid received at said chord interface, and
- a music generator that automatically generates a real time music accompaniment based on said chord grid received at said chord interface and said at least one played chord of said chord grid by transforming one or more of said at least one played chords into the remaining chords of said chord grid.

According to a further aspect there is provided a corresponding method for generating a real time music accompaniment, said method comprising receiving a chord grid comprising a plurality of chords, receiving at least one chord of a chord grid received at said chord interface, and automatically generating a real time music accompaniment based on said chord grid received at said chord interface and said at least one played chord of said chord grid by transforming one or more of said at least one played chords into the remaining chords of said chord grid.

According to still further aspects a computer program comprising program means for causing a computer to carry out the steps of the method disclosed herein, when said computer program is carried out on a computer, as well as a non-transitory computer-readable recording medium that stores therein a computer program product, which, when executed by a processor, causes the method disclosed herein to be performed are provided.

Preferred embodiments are defined in the dependent claims. It shall be understood that the claimed method, the claimed computer program and the claimed computer-readable recording medium have similar and/or identical preferred embodiments as the claimed device and as defined in the dependent claims.

One of the aspects of the disclosure is to apply a new approach, e.g. to loop pedals, which is based on an analytical multi-modal representation of the music (audio) input. Instead of simply playing back pre-recorded audio, the proposed device and method enable real-time generation of an audio accompaniment reacting to what is being performed by the musician. By combining two or more music modes automatically, solo musicians can perform duets or trios with themselves, without engendering canned music effects. Accordingly, a supervised classification of input music and, preferably, a concatenative synthesis are performed. This approach opens up new avenues for concert performance.

Another aspect of the disclosure is to enable musicians to quickly feed a loop without having to play it entirely. This is achieved by providing the chord grid and implementing a mechanism that reuses already played bars or chords using e.g. pitch scaling techniques, i.e. to make a transformation (in particular a transposition and/or substitution) of the audio signal, and/or chord substitution rules. Thus, the loop (or, more generally, the real time music accompaniment) is generated from a limited amount of music material, typically a bar or a few bars. Preferably, the "cost" of the transformation is minimized to ensure the greatest quality of the played signal.

Further, the disclosed device and method generate an improved real time music accompaniment that make performances by use of such a device or method less monotonous and boring both to the musician and the audience and that make the performances fully understandable by the audience as generally nothing is pre-recorded.

In this context it shall be understood that a piece of music does not necessarily mean a complete song or tune, but generally means one or more chords or beats. The device and method for generating a real time music accompaniment are generally directed to the generation of the accompaniment during a playback phase (or state), i.e. when a musician wants to be accompanied while he is playing. The device and method for recording pieces of music for use in generating a real time music accompaniment are generally directed to the recording of music during a recording phase (or state) that can later be used in a playback phase.

Further, it shall be noted that a chord is generally associated to each "temporal position" in the grid, e.g., a measure, or a beat. A performance is a walk through the sequence of chords. When the musician plays something during a performance, it is systematically associated to the corresponding chord. Thus, chords may generally be three different things, namely a position in the grid, an information on the harmony, and a physical chord played on a musical instrument.

It is to be understood that both the foregoing general description and the following detailed description are exemplary, but are not restrictive of the disclosure.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 12 shows a table with a set of substitution rules, and FIG. 13 shows a rule with every possible root for the original chord.

DESCRIPTION OF THE EMBODIMENTS

Solo improvised performance is arguably the most challenging situation for a musician, in particular for jazz. The main reason is that in order to produce an interesting musical discourse, many dimensions of music should be performed simultaneously, such as beat, harmony, bass and melody. A solo musician should incarnate the roles of a whole rhythm section, like in a standard jazz combo such as piano, bass and drums. Additionally, they should improvise a solo while maintaining the rhythm section. Technically this is possible only for few instruments like the piano, but even in that case it requires great virtuosity. For guitars, solo performance is even more challenging as the configuration of the instrument does not allow for multiple simultaneous music streams. In the 80s, virtuoso guitarist Stanley Jordan stunned the musical world by playing simultaneously bass, chords and melodies using a technique called "tapping". But such techniques are hard to master, and the resulting music, while exciting, is arguably stereotyped.

Figure 1:
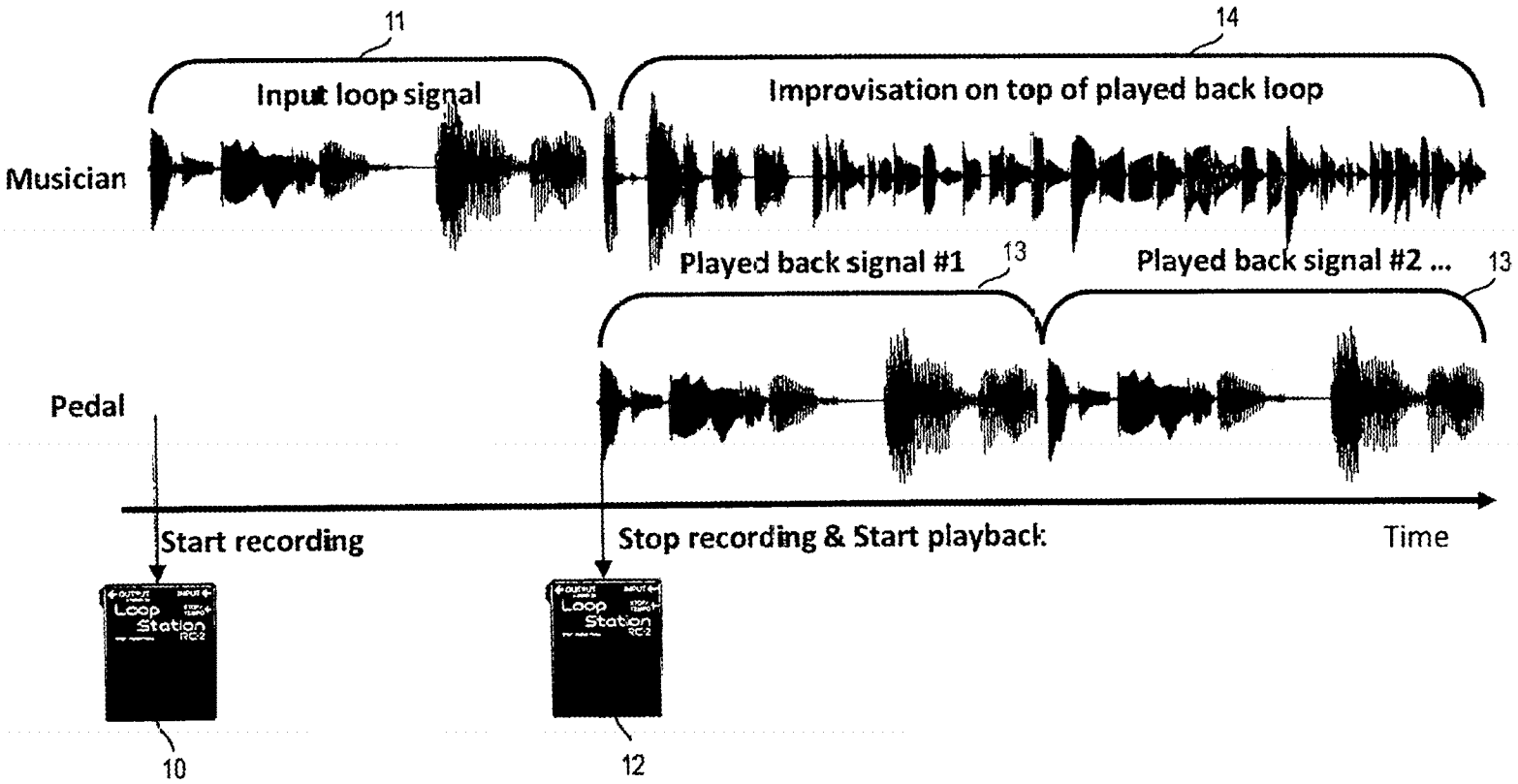
FIG. 1 shows a diagram illustrating a typical loop pedal interaction.

Several technologies are known to cope with the limitations of solo performers by aiming to extend their expressiveness. One of the most popular is the loop pedal as described in Boss, RC-3 Loop Station Owner's Manual, (2011). Loop pedals are digital samplers that record a music input during a certain time frame, determined by clicking on the pedal. FIG. 1 shows a typical use of a loop pedal for performing. A first click 10 activates the recording of the input 11. A subsequent click 12 determines the length of the loop and starts the playback of the recorded loop 13 while in parallel the musician can start an improvisation 14.

With such loop pedals the musician typically first records a sequence of chords (or a bass line) and then improvises on top of it. This scheme can be extended to stack up several layers (e.g. chords then bass) using other interactive widgets (e.g. double clicking on the pedal). Loop pedals enable musicians to literally play two (or more) tracks of music in real-time. However, they invariably produce a canned music effect due to the systematic repetition of the recorded loop without any variation whatsoever.

Another popular and inspiring device for enabling solo performance is the minus-one recording, such as the Aebersold series as described in Aebersold, J., How To Play Jazz & Improvise, Book & CD Set, Vol. 1, (2000). With these recordings, the musician is able to play a tune with a fully-fledged professional rhythm section. Though of a different nature, the canned effect is still there: playing with a recording generates stylistic mismatch. Stylistic consistency is lost, as it is no longer only the musician playing, but other, invisible musicians, which eliminates the interactive nature of real-time improvisation and lessens the musical impact on the audience. Consequently, these devices are hardly used in concerts or recordings, and their usage remains limited to practice or busking (low-profile outdoor playing).

Previous works have attempted to extend traditional instruments, such as the guitar, by using real-time signal analysis and synthesis. For example, Lähdeoja, O., An approach to instrument augmentation: the electric guitar, Proc. New Interfaces for Musical Expression conference, NIME (2008) showed how to detect fine-grained playing modes from the analysis of the incoming guitar signal, and Reboursière, L. Frisson, C. Lähdeoja, O. Anderson, J. Iii, M. Picard, C. Todoroff, T., Multimodal Guitar: A Toolbox For Augmented Guitar Performances, Proc. of NIME, (2010) proposed a rearranging loop pedal that detects and reshuffles randomly note events within a loop. In Hamanaka, M. Goto, M. Asoh, H. and N. Otsu, A learning-based jam session system that imitates a player's personality model. IJCAI, pp. 51-58, (2003) a MIDI-based model of an improviser's personality is proposed, to build a virtual trio system, but it is not clear how it can be used in realistic performance scenarios requiring a predetermined harmony and tempo. Finally, Cherla, S., Automatic Phrase Continuation from Guitar and Bass-guitar Melodies, Master thesis, UPF, (2011) proposes an audio-based method for generating stylistically consistent phrases from a guitar or bass but this applies only to monophonic melodies. O max is a system for live improvisation that plays musical sequences built incrementally and in real-time from a live MIDI or Audio source as described in Lévy, B., Bloch, G., Assayag, G., OMaxist Dialectics: Capturing, Visualizing and Expanding Improvisations, Proc. NIME 2012, Ann Arbor, 2012. O max uses feature similarity and concatenative synthesis to build clones of the musician, thus extending the instrument by creating rich textures by superimposing the musician's input with the clones. This makes this approach suitable for free musical improvisation. Although reflexive loop pedals bear many technical similarities with O max, they are intended for traditional (solo) jazz improvisation involving harmonic and temporal constraints as well as combining heterogeneous instruments and/or modes of playing, as will be explained below.

Observing real jazz combos (duos or trios) gives clues to what a natural extension of a jazz instrument could be. In a jazz duo for instance, musicians typically alternate between comping (providing harmony with chords) and solo (e.g. melodies). Each musician also adapts in a mimetic way to the other(s), for instance in terms of energy, pitch or note density. Based on these observations, so-called Reflexive Loop Pedals are proposed representing a novel approach to loop pedals that enables musicians to expand their musical competence as if they were playing in a duo or trio with themselves, but which avoids the canned music effect of pedals or minus-one recordings. This is achieved by enforcing stylistic consistency (no external pre-recorded material is used) while allowing natural interaction between the human and the played back material. In the following the proposed approach will be explained in more detail and a solo guitar performance will be described as an example.

Figure 2:
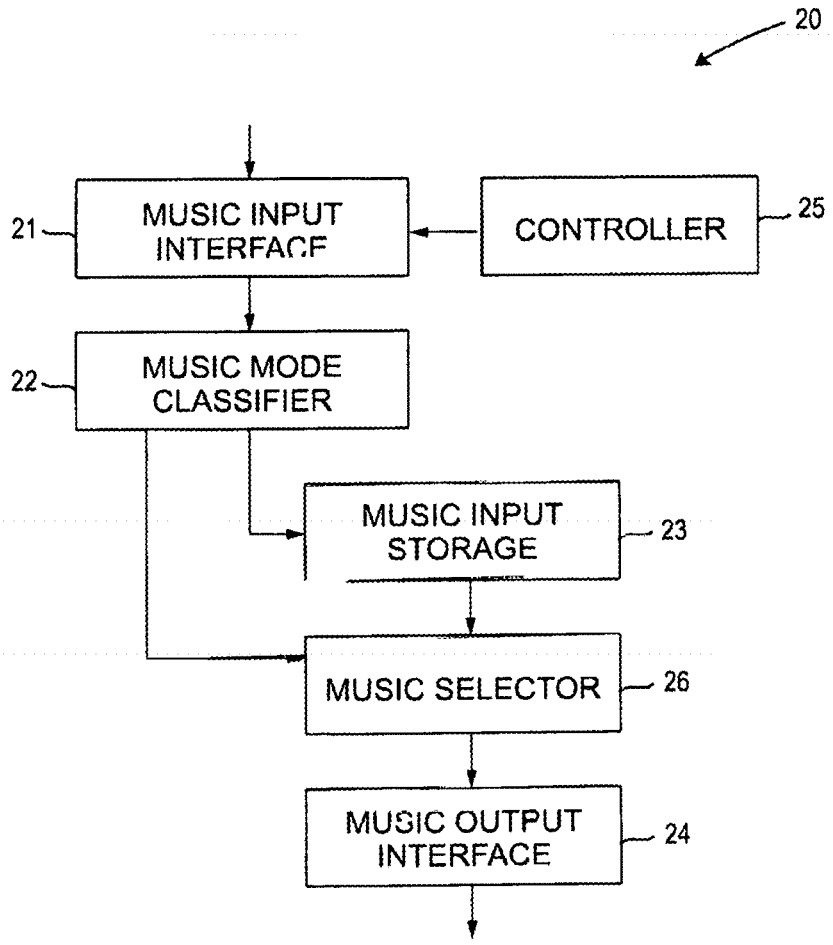
FIG. 2 shows a schematic block diagram of a first embodiment of a device for generating a real time music accompaniment according to the present disclosure.

FIG. 2 shows a schematic block diagram of a first embodiment of a device 20 for generating a real time music accompaniment according to the present disclosure. The device 20 comprises a music input interface 21 that receives pieces of music played by a musician. A music mode classifier 22 is provided that classifies pieces of music received at said music input interface into one of different music modes including at least a solo mode, a bass mode and a harmony mode. A music storage 23 records (stores) pieces of music received at said music input interface along with the corresponding mode in a recording phase. A music output interface 24 outputs pieces of music previously recorded in the music storage in a playback phase. Further, a controller 25 is provided that controls said music input interface to switch between said recording phase and said playback phase. Finally, a music selector 26 selects, in said playback phase, one or more stored pieces of music from the pieces of music stored in said music storage as real time music accompaniment to an actually played piece of music received a said music input interface, wherein said one or more selected pieces of music are selected to be in a different music mode than the actually played piece of music.

Such a device is referred to as reflexive loop pedal (RLPs) herein. RLPs follow the same basic principle as standard loop pedals: they play back music material performed previously by the musician. RLPs differ in at least one aspect: RLPs manage to differentiate between several playing modes, such as bass, harmony (chords) and solo melodies. Depending on the mode the musician is playing at any point in time, the device will play differently, following the "other members" principle. For instance, if the musician plays a solo, the RLP will play bass and/or chords. If the musician plays chords, the RLP will play bass and/or solo, etc. This rule ensures that the overall performance is close to a natural music combo, where in most cases bass, chords and solo are always present but never overlap.

Figure 3:
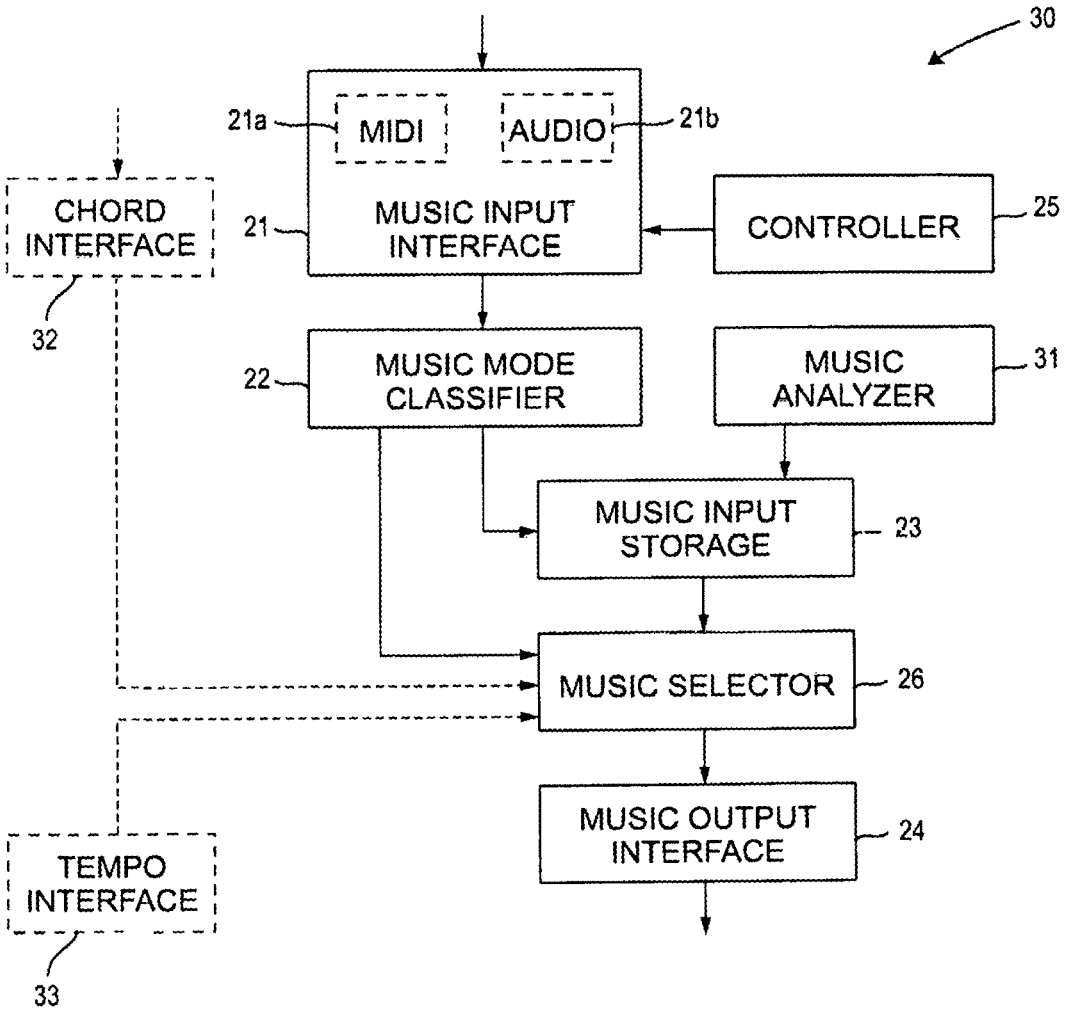
FIG. 3 shows a schematic block diagram of a second embodiment of a device for generating a real time music accompaniment according to the present disclosure.

In a preferred embodiment the playback material is determined not only according to the current position in the loop, but also to a predetermined chord grid and/or to the current playing of the musician, in particular through feature-based similarity. This ensures that any generated accompaniment actually follows the musician's playing. A corresponding second embodiment of a device 30 for generating a real time music accompaniment according to the present disclosure is schematically shown in FIG. 3. Said device 30 comprises, in addition to the elements of the device 20 shown in FIG. 2, a music analyzer 31 that analyzes a received piece of music to obtain a music piece description comprising one or more characteristics of the analyzed piece of music, i.e. said music piece description representing a feature analysis of input music. Said music piece description is stored in said music storage 23 along with the corresponding piece of music in the recording phase. The music selector 26 then takes the music piece description of an actually played piece of music and of stored pieces of music into account in the selection of one or more stored pieces of music as real time music accompaniment.

Preferably, said music analyzer 31 is configured to obtain a music piece description comprising one or more of pitch, bar, key, tempo, distribution of energy, average energy, peaks of energy, number of peaks, spectral centroid, energy level, style, chords, volume, density of notes, number of notes, mean pitch, mean interval, highest pitch, lowest pitch, pitch variety, harmony duration, melody duration, interval duration, chord symbols, scales, chord extensions, relative roots, zone, type of instrument(s) and tune of an analyzed piece of music.

Optionally, as shown in FIG. 3 with dashed lines, the device 30 further comprises a chord interface 32 that is configured to receive or select a chord grid comprising a plurality of chords (generally arranged in a sequence). Thus, a user can enter a chord grid (also referred to as chord interface) or can select a chord grid from a chord grid database. In such an embodiment the music analyzer 31 is configured to obtain a music piece description comprising at least the chords of the beats of the analyzed piece of music. Further, said music selector 26 is configured to take the received or selected chord grid of an actually played piece of music and the music piece description of stored pieces of music into account in the selection of one or more stored pieces of music as real time music accompaniment.

Figure 4:
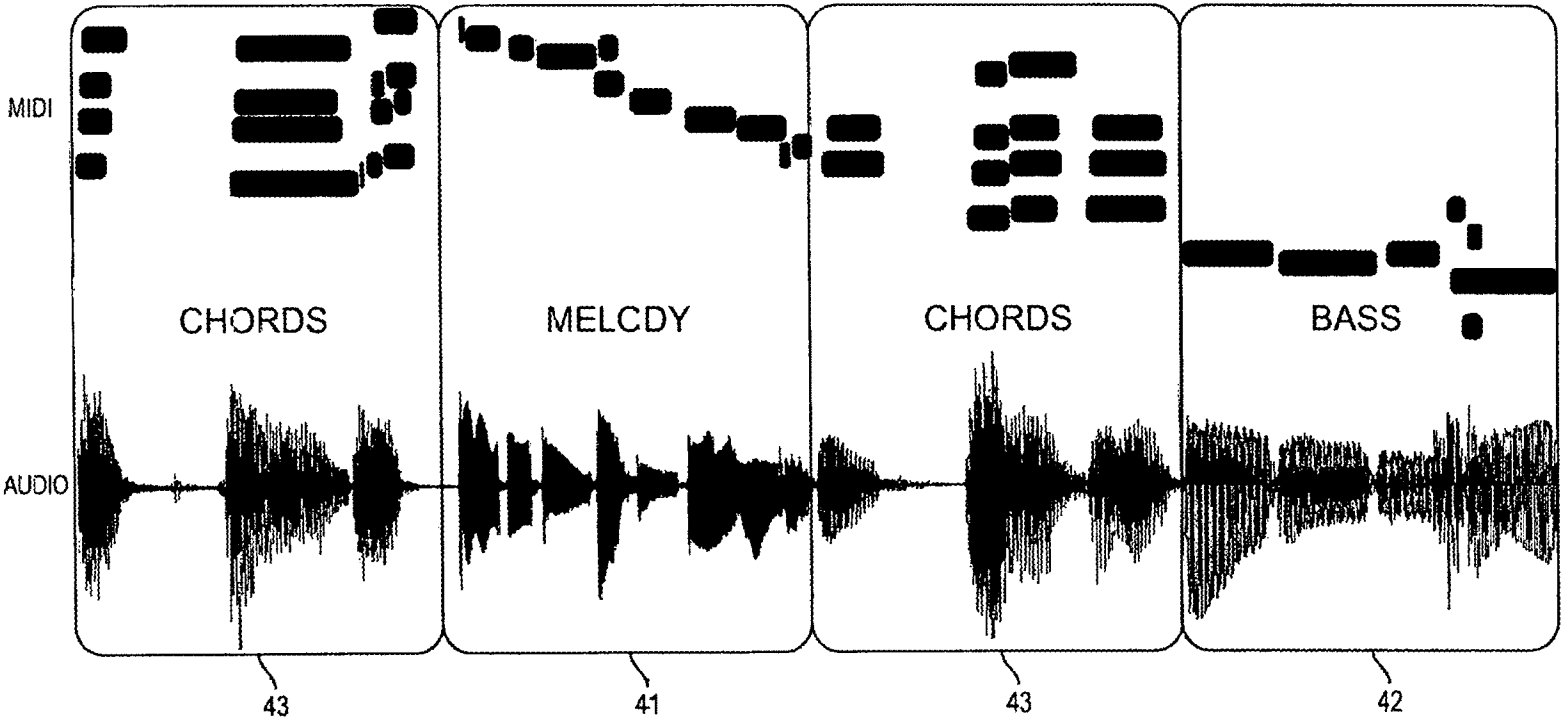
FIG. 4 shows a diagram illustrating the mode classification of input music.

In a preferred implementation, input music is received both as an audio and a MIDI stream. Accordingly, the music input interface 21 preferably comprises a midi interface 21*a* and/or an audio interface 21*b* for receiving said pieces of music in midi format and/or in audio format as also shown in FIG. 3 as an additional option. Accordingly, said music mode classifier 22 is configured to classify pieces of music in midi format, said music analyzer 31 is configured to analyze pieces of music in audio format and said music storage 23 is configured to record pieces of music in audio format. Audio is preferably used for extracting interaction features and concatenative synthesis (i.e. in the generation of the audio accompaniment) and MIDI is preferably used for analysis and classification as shown in FIG. 4. Said figure illustrates the classification of the musician's input into different modes, in particular into pieces of music in solo mode 41, a bass mode 42 and a harmony (chords) mode 43.

Like in many jazz accompaniment systems, a chord grid is provided a priori as explained above and as illustrated in the following table.

| | | | |
|---|---|---|---|
| C min | % | G-7 | C7 |
| F maj7 | % | F-7 | Bb7 |
| Eb maj7 | Eb-7/Ab7 | Db maj7 | D-7/G7 |

Said table shows a typical chord grid. Some chords are repeated (e.g. here, C min and F maj7), providing more choice for the device and method during generation of the accompaniment. The chord grid is preferably used to label each played beat with the corresponding chord. A preferred constraint imposed to RLPs is that each played-back audio segment should correspond to the correct chord in the chord grid. A grid often contains several occurrences of the same chord which enables the device to reuse a given recording for a chord several times, which increases its ability to adapt to the current playing of the musician.

Further, in still another implementation a tempo is preferably provided as well, e.g. via an optionally provided tempo interface 33 (also shown in FIG. 3) that is configured to receive or select a tempo of played music. In this case the music selector 26 is configured to take the received or selected tempo of an actually played piece of music into account in the selection of one or more stored pieces of music as real time music accompaniment.

In the following an embodiment will be described how the device and method can automatically classify the musician's input into the different music modes. In this context, musically meaningful macro modes are considered, corresponding to different musical intentions, such as bass, chords and solo. Particularly the mode classification for guitar will be considered, but this applies to other instruments, e.g. the piano, with the same performance.

In this exemplary embodiment a corpus of 8 standard jazz tunes in various tempos and feels (e.g. Bluesette, Lady Bird, Nardis, Ornitholo-gy, Solar, Summer Samba, The Days of Wine and Roses, and Tune up) is built. For each tune, three guitar performances of the same duration (about 4') were recorded: one with bass, one with chords, and one with solos, by playing e.g. along with an Aebersold minus-one recording. For each performance both audio and MIDI (e.g. using a Godin MIDI guitar) were recorded, for a total of 5,418 bars. The MIDI input is segmented into one-bar 'chunks', at the given tempo. Chunks are not synchronized to the beat, to ensure that the resulting classifier is robust, i.e. is able to readily classify any musical input, including ones that are out of time, which is a common technique used in jazz.

Figure 5:
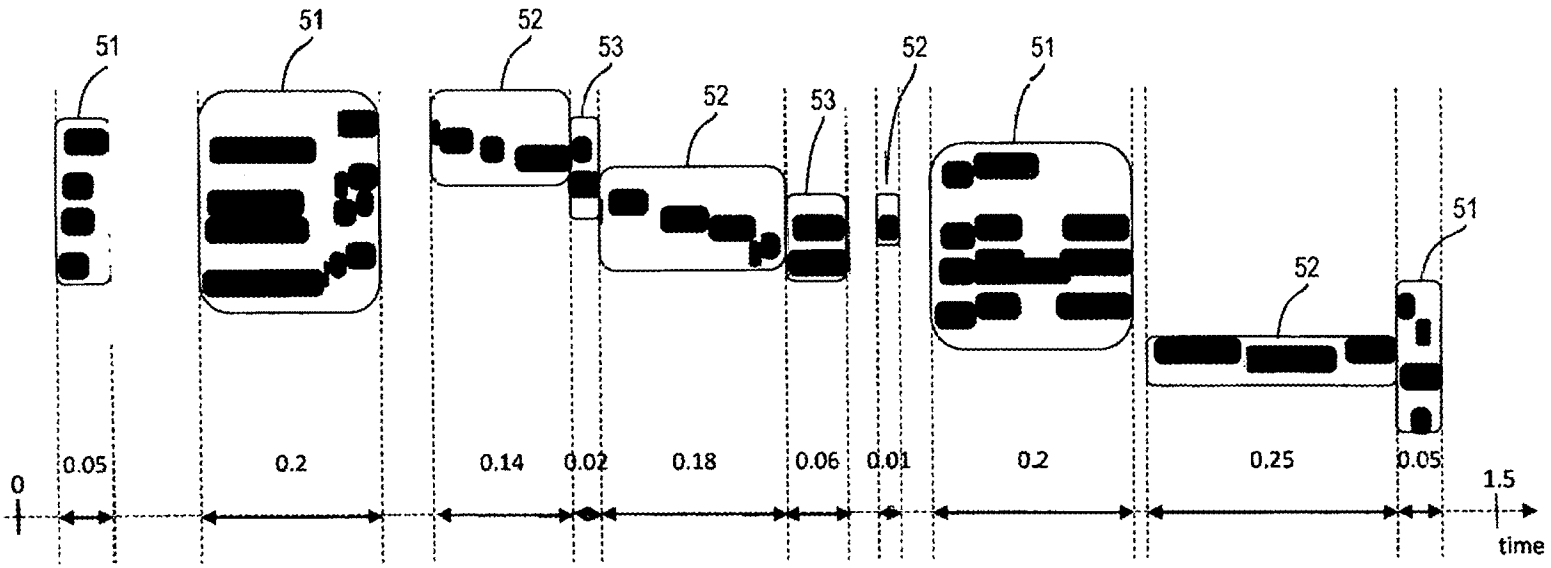
FIG. 5 shows a diagram illustrating the generating of a music piece description.

One tune (e.g. Bluesette) was to perform feature selection. The initial feature set contains 20 MIDI features related to pitch, duration, velocity, and statistical moments thereof, and three specific bar structure features: harmony-dur, melody-dur, interval-dur (dur meaning duration here) as shown in FIG. 5. The exemplary feature selection method used is CfsSubsetEval with the BestFirst search method of Weka (as e.g. described in I. W. Witten and F. Eibe, Data Mining: Practical Machine Learning Tools and Techniques, 2nd ed. San Francisco, Calif.: Morgan-Kaufmann, 205). Nine features were selected: number of notes, mean-pitch, mean interval, highest-pitch, lowest-pitch, pitch-variety (percentage of unique MIDI pitches), harmony-dur, melody-dur, and interval-dur.

In particular, FIG. 5 shows computing the melody, harmony, and interval duration percentage features: Segments 51 comprising 3 or more notes playing together correspond to harmony. Segments 52 comprising 1 note correspond to melody. Segments 53 comprising 2 notes correspond to intervals. The bar lasts 1.5 s. Cumulated durations of harmony, melodies, and intervals are respectively 0.5 s, 0.68 s, and 0.08 s. The feature values for this bar are therefore harmony dur=33%, melody dur=45%, interval dur=5%.

A Support Vector Machine classifier (e.g. Weka's SMO) is preferably used and trained on the labeled data with the selected features. The following table shows the performance of an SVM (Support Vector Machine, which is a standard machine-learning) classifier on each individual tune measured with a 10-fold cross-validation with a normalized poly-kernel. Last row shows the performance of the classifier trained on all 8 tunes. As indicated in said table classification results are near perfect, ensuring robust mode identification during performance.

| | Classifier F-measure | | |
|---|---|---|---|
| Tune | Bass | Solo | Harmony |
| Bluesette | 99.7% | 99.1% | 99.1% |
| Lady Bird | 98.2% | 98.9% | 97.5% |
| Nardis | 97.7% | 98.7% | 96.6% |
| Ornithology | 99.2% | 99.2% | 98.4% |
| Solar | 99.4% | 98% | 97.3% |
| Summer Samba | 98% | 98.9% | 97.4% |
| The Days of . . . | 97.9% | 98.9% | 97.2% |
| Tune Up | 98.3% | 100% | 98.3% |
| All | 98.6% | 97.7% | 99% |

During performance, audio streams are preferably generated using concatenative synthesis from audio material previously played and classified. Generation is done according to two principles.

The first principle is called "the other members principle". The currently played music is analyzed by the mode classifier, which determines the two other music modes to generate (e.g. bass=>chords & solo, chords=>bass & solo, solo=>bass & chords). In case no previously played bar is yet available, the generation outputs silence.

The second principle is called "feature-based interaction". According to an aspect the proposed device and method do not simply play back a recorded sequence, but generate a new one, adapted to the current real-time performance of the musician. This is preferably achieved using feature-based similarity (in particular using a music piece description as explained above). Audio features from the user's input music are extracted. For instance, in an implementation the user features are RMS (mean energy of the bar), hit count (number of peaks in the signal) and spectral centroid, though other MPEG-7 features could be used (see, e.g., Peeters, G., A large set of audio features for sound description (similarity and classification) in the CUIDADO project, Ircam Report (2000)). The device and method attempt to find and play back recorded bars of the right modes (say, chords and bass if the user is playing melody), correct grid chord (say, C min), and that best match the user features. Feature matching is preferably performed using Euclidean distance.

Audio generation is preferably performed using concatenative synthesis as e.g. described in Schwarz, D., Current research in Concatenative Sound Synthesis, Proc. Int. Computer Music Conf. (2005). Thus, audio beats are concatenated in the time domain and crossfaded to avoid audio clicks.

The proposed approach is proven with a solo guitar performance with the system on the tune "Solar" by Miles Davis. During this 2'50" performance, the 12-bar tune is played 9 times. The musician played alternatively chords, solos, and bass, and the device and method reacted according to the 2 "other members" principle. Moreover, the device and method generated an accompaniment that matches the overall energy of the musician: soft passages are accompanied with low-intensity bass lines (i.e., bass lines with few notes as the hit count user feature is considered), and with low-energy harmonic bars (i.e., with soft chords, as user feature RMS is considered), and conversely.

Figure 6:
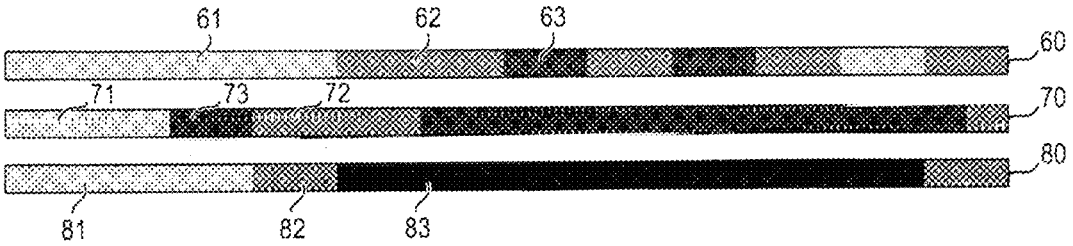
FIG. 6 shows a time diagram illustrating a performance including actually played music and playback of stored music in two different music modes.

FIG. 6 shows a time-line of one grid (#9) of the performance emphasizing mode generation and interplay, as well as the feature-based interaction. In particular, FIG. 6 shows an extract of a performance of Solar with a guitar and the system. Following the 2 "other members" principle, the device and method do not play any melody. The chords do not follow the musician's input as no high energy chords were recorded for bars 6, 8, 10, 11, and 12. The bass follows the musician's energy more closely as low energy bass was not recorded for bars 3 and 4. In FIG. 6 row 60 shows the chords played by the device and method, including chords 61 with low energy, chords 62 with medium energy and chords 63 with high energy. Row 70 shows the melody played by the device and method, including melody 71 with low energy, melody 72 with medium energy and melody 73 with high energy. Row 80 shows the bass played by the device and method, including bass 81 with low energy, bass 82 with medium energy and bass 83 with high energy.

Figure 7:
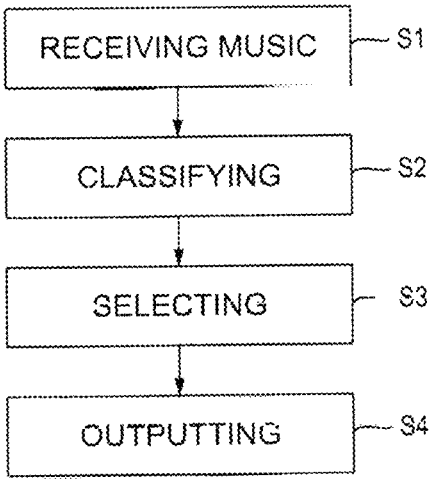
FIG. 7 shows a flowchart illustrating a method for generating a real time music accompaniment according to the present disclosure.
Figure 8:
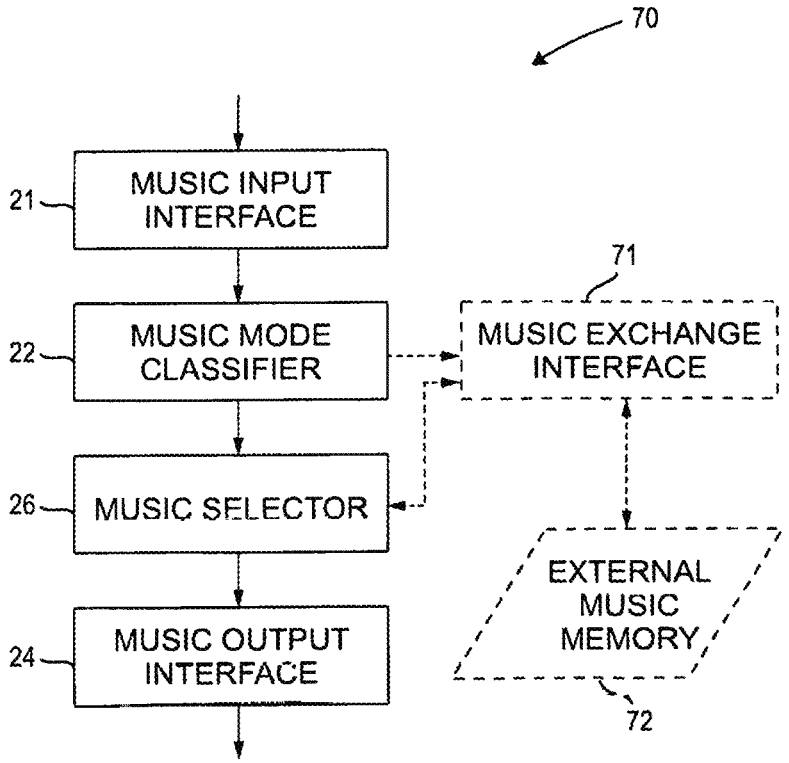
FIG. 8 shows a schematic block diagram of a third embodiment of a device for generating a real time music accompaniment according to the present disclosure.

FIG. 7 shows a flowchart of a method for generating a real time music accompaniment according to the present disclosure. In a first step S1 pieces of music played by a musician are received. In a second step S2 received pieces of music are classified into one of different music modes including at least a solo mode, a bass mode and a harmony mode. In a third step S3 one or more recorded pieces of music are selected as real time music accompaniment to an actually played piece of music, wherein said one or more selected pieces of music are selected to be in a different music mode than the actually played piece of music. Finally, in a fourth step S4 the selected pieces of music are output as music accompaniment to the actually played music A third, more general embodiment of a device 70 for generating a real time music accompaniment according to the present disclosure is shown in FIG. 7. It comprises a music input interface 21 that receives pieces of music played by a musician. A music mode classifier 22 classifies pieces of music received at said music input interface into one of different music modes including at least a solo mode, a bass mode and a harmony mode. A music selector 26 selects one or more recorded pieces of music as real time music accompaniment to an actually played piece of music received at said music input interface, wherein said one or more selected pieces of music are selected to be in a different music mode than the actually played piece of music. Finally, a music output interface 24 outputs the selected pieces of music.

Optionally, as shown in dashed lines, the device 70 further comprises a music exchange interface 71 that is configured to record pieces of music received at said music input interface 21 along with its classified music mode in an external music memory 72, e.g. an external hard disk, computer storage or other memory provided external to the device (for instance, storage space provided in a cloud or the internet). The music selector 26 is configured accordingly to select, via said music exchange interface 71, one or more pieces of music from the pieces of music recorded in said external music memory 72 as real time music accompaniment.

Figure 9:
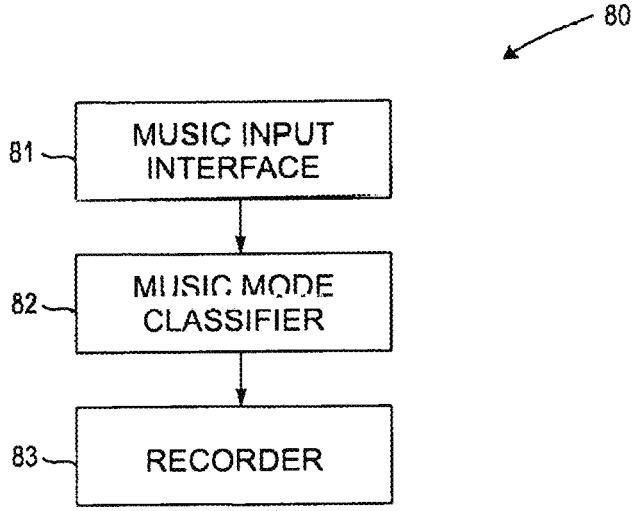
FIG. 9 shows a schematic block diagram of an embodiment of a device for recording pieces of music for use in generating a real time music accompaniment according to the present disclosure.

The above explained embodiments of the device and method mainly relate to the playback phase or to both the recording phase and the playback phase. According to another aspect the present disclosure also relates to a device and a corresponding method for recording pieces of music for use in generating a real time music accompaniment, i.e. said device and method relating to the recording phase only. An embodiment of such a device 80 is shown in FIG. 9. It comprises a music input interface 81 (which can generally be the same or a similar interface as the music input interface 21) that receives pieces of music played by a musician. Further, the device 81 comprises a music mode classifier 82 (which can generally be the same or a similar classifier as the music mode classifier 22) that classifies pieces of music received at said music input interface 21 into one of different music modes including at least a solo mode, a bass mode and a harmony mode. Still further, the device 80 comprises a recorder 83 that records pieces of music received at said music input interface 81 along with the classified music mode.

The recorder 83 can be implemented as music storage like e.g. the music storage 23 or may be configured to directly record on such a music storage. In another embodiment the recorder 83 can be implemented as music exchange interface like e.g. the music exchange interface 71 to record on an external music memory.

The above described device and method address two critical problems of existing music extension devices, namely lack of adaptiveness (loop pedals are too repetitive) and stylistic mismatch (playing along with minus-one recordings generates stylistic inconsistency). The above described approach is based on a multi-modal analysis of solo performance that preferably classifies every incoming bar automatically into one of a given set of music modes (e.g. bass, chords, solo). An audio accompaniment is generated that best matches what is currently being performed by the musician, preferably using feature matching and mode identification, which brings adaptiveness. Further, it consists exclusively of bars the user played previously in the performance, which ensures stylistic consistency.

As a consequence, a solo performer can perform as a jazz trio, interacting with themselves on any chord grid, providing a strong sense of musical cohesion, and without creating a canned music effect.

The new kind of interaction described above with regard to FIGS. 1-9 was inspired by observations of, and participation in, real jazz bands. Many other scenarios have been investigated including, for instance, an automatic mode in which the musician stops playing and simply controls the generated streams (bass, chord, solo) using gestural controllers, so as to let them focus on structure rather than on actual playing. Whilst the approach described above is entirely automatic, and works without any actual controller, physical controllers can be introduced to bring more control to the musician on the audio they have generated. A freeze pedal could allow the musician to play along in a preferred configuration without interfering with it. Another configuration would consist in playing a solo on top of a generated one. In a final case, the device and method could be allowed to play the 3 performance modes, and control each of them with dedicated controllers located on the instrument.

A preferred implementation uses a MIDI stream for mode classification. MIDI is available from synthesizers, some pianos or guitars, but not all instruments. Current work addresses the identification of robust audio features required to perform mode classification directly from the audio signal. This will generalize the approach to any instrument. In another embodiment there is a MIDI implementation and an AUDIO implementation. These two implementations are exclusive.

Figure 10:
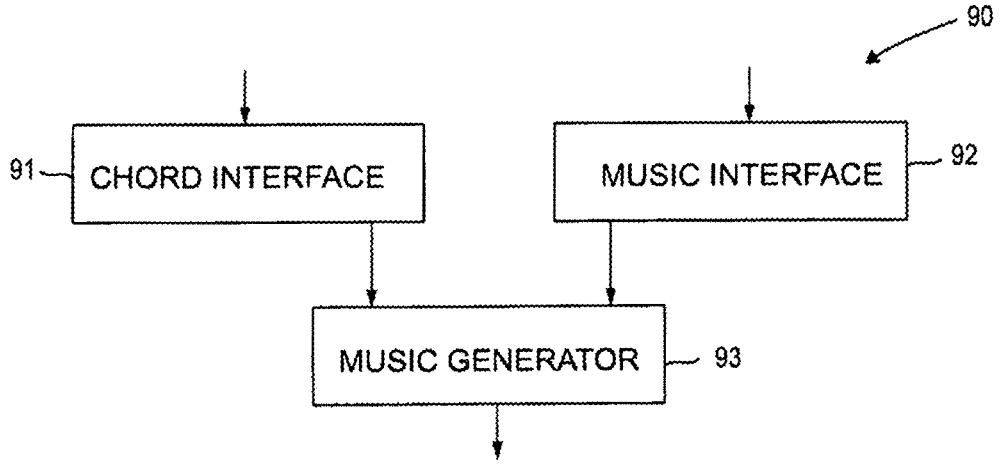
FIG. 10 shows a schematic block diagram of an embodiment of a device for generating a real time music accompaniment according to the present disclosure.

A schematic block diagram of an embodiment of a device 90 according to the present disclosure is shown in FIG. 10. The device 90 comprises a chord interface 91 that is configured to receive a chord grid comprising a plurality of chords, a music interface 92 (e.g. a microphone or a MIDI interface) that is configured to receive at least one played chord of a chord grid received at said chord interface, and a music generator 93 that automatically generates a real time music accompaniment based on said chord grid received at said chord interface and said played at least one chord of said chord grid, preferably even if less than all chords of said chord grid are played and received at said music interface, by transforming (in particular transposing and/or substituting) one or more of said at least one played chords into the remaining chords of said chord grid.

The device 90 according to this embodiment allows generating a loop from a limited amount of music material, typically a bar or a few bars. Thus, in effect, a new form of loop pedal is proposed, which is targeted at situations in which the chord grid is known in advance. In that case, the chord grid is specified to the pedal (i.e. the device) through the chord grid interface (e.g. through any GUI, or by selecting from a library of chord grids, etc.). A typical example for a chord grid is a blues, e.g. "C7|C7|C7|C7|F7|F7|C7|C7|G7|F7|C7|C7" (or something like that).

The idea is that instead of playing the whole loop entirely, the "enhanced pedal" now only needs to record the first bar (or chord) or the first bars (or chords), for instance a C7 chord, played in whatever style. Thus, a musician actually plays only one or more chords, and these played bar(s) or chord(s) is (are) then transformed digitally, for instance using known pitch scaling algorithms, in this example in F7 and G7. As a consequence, the user can start improvising right away after the first bar(s) or chord(s), i.e. much faster than with known loop pedals. While generally the at least one played chord is played live and in real-time, it is generally possible that the at least one chord is played and recorded in advance and is, for the generating the actual accompaniment, received as pre-recorded input, e.g. via a data interface or microphone.

Several problems generally occur when pitch scaling an audio signal: the frequency bins in the original signal shall not change, the phase of the output shall be coherent, and the transients shall not be stretched. Phase vocoding is an algorithm that uses Short Time Fourier Transform (STFT) and Overlap-And-Add (OLA), and recalculates the phase of the signal. As a drawback, the phase vocoder degrades (smears) the transients and adds a reverberation effect to the output. SOLA (Synchronous Overlap-And-Add) improves phase vocoding by synchronizing the analysis/synthesis frames used for OLA with the fundamental frequency of the signal. Its efficiency depends on the type of the input signal, and complex sounds will be harder to scale (monophonic sounds will be easier to scale). Another method uses granular (re)synthesis, coupled with a transient detector, to leave the transients un-stretched (the recent IRCAM's Mach Five uses this technology). In the case of speech, other algorithms show very good results, such as linear prediction based vocoders or the PSOLA algorithm (Pitch Synchronous Overlap and Add).

Thus, an algorithm is preferably used by the music generator 93 that generates a sequence of audio accompaniment, given an a priori chord grid, and partial audio chunks, corresponding to some of the chords of the sequence. In practice, the musician can lay only the first one or more bars, or, during his performance, play other bars anywhere in the chord grid (played in loop). The algorithm generates an audio accompaniment given these incomplete audio inputs. In an embodiment the output of this algorithm is constantly updated (e.g. at every bar).

Preferably, the algorithm tries to minimize the number of transformations and their range (it is better to transpose as little as possible to minimize artefacts) in the generated audio accompaniment. A transformation generally is a substitution, a transposition or a combination of a substitution with a transposition. The "range" refers to the transposition, and the range of a transposition is the frequency ratio between the original frequency and the transposed frequency. For a small change in frequency, e.g., transpositions of one semitone, the audio quality is almost perfect; for larger changes in frequency, e.g., transposition by a fifth, the audio quality is degraded. The use of a substitution may create an odd feeling (what is played does not necessarily match perfectly the expected harmony . . . ). Therefore, the aim of the disclosed approach is to minimize the number of transformations to avoid both "odd harmonies" due to substitutions and "audio degradations" due to transpositions.

Moreover, the algorithm can use "chord substitutions" to avoid transpositions when possible. For instance, instead of a C major seven, one could use a E minor, etc. A complete list of substitution is given in FIG. 12. The algorithm ensures an optimal sequence regarding these constraints. Chord substitution is the idea that some chords are more or less musically equivalent to others, "tonally speaking". This means that they have important notes in common, and differ only by non-important notes, so they can be substituted to a certain degree. This idea has been formalized by introducing a set of substitution rules that explicitly state which chords can be substituted to which other chords. Chord substitution involve usually both a transposition of the tonic and a change in the type of chord. For instance, a well-known substitution is the so-called "relative minor" substitution that states that any major chord (say, C Major) can be substituted by its relative minor (A minor).

In an embodiment the music interface 92 comprises a start-stop interface for starting and stopping the reception and/or recording of chords played by a musician. Said start-stop interface may e.g. comprise a pedal. Further, in an embodiment said chord interface 91 is a user interface for entering a chord grid and/or selecting a chord grid from a chord grid database. Further, a music output interface, e. g. a loudspeaker, may be provided that is able to output the generated music accompaniment.

Generally, the musician (or someone else) decides in advance which chord progression to follow and which chords to play. In another embodiment, however, a unit configured to receive audio input and classify it as a certain chord of the chord grid is provided. Further, in an embodiment a unit for storing received and generated music may be provided.

Figure 11:
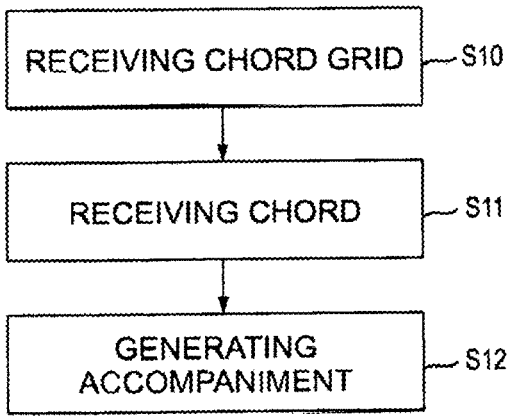
FIG. 11 shows a flowchart illustrating an embodiment of a method for generating a real time music accompaniment according to the present disclosure.

FIG. 11 shows a flowchart of a corresponding method for generating a real time music accompaniment according to the present disclosure. In a first step S10 a chord grid comprising a plurality of chords is received. In a second step S11 at least one chord of a chord grid received at said chord interface is received, said at least one chord being preferably played by a musician. In a third step S12 a real time music accompaniment is automatically generated based on said played chord grid received at said chord interface and said played at least one chord of said chord grid, preferably even if less than all chords of said chord grid are played and received at said music interface, by transforming one or more of said at least one played chords into the remaining chords of said chord grid. Thus, the disclosed music accompaniment is preferably generated from an incomplete chord set, but the disclosed device and method may generally also be useful for substituting chords even if there is a suitable prerecorded chord, to enhance the listening experience by creating unexpected sounds.

In the following a description of a generalizing harmonization device will be provided in the context of improvized tonal music, such as, but not limited to, bebop jazz. In this context, a chord progression (also referred to as "chord grid" herein) is decided before starting the actual improvization, maybe by selection from a list displayed in a corresponding user interface. The chord progression defines that harmony of each bar of the tune. During the improvization one or several musicians play together following the harmonies specified by the chord progression. Typically, one of the musicians plays an accompaniment, for instance chords, while another one simultaneously plays a solo melody, in the same harmony.

Generally, a harmonization device generates an accompaniment for one or more musicians improvising on a predefined chord progression. The accompaniment fits the harmonic structure of the corresponding bar in the chord progression. A harmonization device can, for instance, synthesize a chord using a MIDI synthesizer, or play back pre-recorded music.

In this context it is conventionally dealt with pre-recorded music. The device takes two inputs: i) a chord database D of pre-recorded bars, each bar having a specific harmonic structure, and ii) a chord progression P. A known device outputs a musical accompaniment comprising a sequence of pre-recorded bars of D. The accompaniment is meant to be played back during an improvization. Note that tempo issues are neglected herein. Further, it shall be assumed that the musical bars in the database D are preferably recorded at the same tempo as that of the improvization.

The following table gives the chord progression of a simple blues. Each bar contains one chord, but some progressions typically specify 1, 2, 3, or 4 chords per bar.

| | | | |
|---|---|---|---|
| C7 | F7 | C7 | C7 |
| F7 | F7 | C7 | A7 |
| D min 7 | G7 | C7 | G7 |

If a database a $D_{blues}$ that contains five bars b1, . . . , b5 is considered with respective harmonic structure C7, F7, A7, D min 7, and G7, a simple harmonization device will play back the sequence of bars: $b_1$, $b_2$, $b_1$, $b_1$, $b_2$, $b_2$, $b_1$, $b_3$, $b_4$, $b_5$, $b_1$, $b_5$ during the improvization. In this case, the database $D_{blues}$ is said to be complete with respect to the chord progression $P_{blues}$, as for every chord in $P_{blues}$ there is a corresponding bar in a $D_{blues}$.

If an incomplete database $D'_{blues}$ consisting of three bars $b_1$, $b_2$, $b_3$ with respective harmonic structure C7, F7, and G7 is considered, a simple harmonization device will play back the sequence of bars: $b_1$, $b_2$, $b_1$, $b_1$, $b_2$, $b_2$, $b_1$, –, –, $b_3$, $b_1$, $b_3$ during the improvization. In this sequence "–" means that nothing is played back.

In this case, the database $D'_{blues}$ is said to be incomplete with respect the chord progression $P_{blues}$, as not for every chord in $P_{blues}$ there is a corresponding bar in $D'_{blues}$.

The disclosed Generalizing Harmonization Device (GHD) aims at generalizing the simple harmonization device presented above to incomplete databases. A GHD uses chord substitution rules and/or chord transposition mechanisms, as explained herein, to generate accompaniments from incomplete databases. A chord c, in this context, consists of a root pitch-class and a harmonic type. This is written as c=(r; t). For instance, chord C7 has root note r(C)=C and is of type t(C)=7, i.e., C7=(C; 7).

The transposition mechanism may use an existing digital signal processing algorithm to change the frequency of an audio signal. The input of the algorithm is the audio signal of a played chord, e.g., C maj, and a number of semitones to transpose, e.g., +3. The output is the audio signal of same duration as the input audio signal, and whose content is a transposed chord of same type, here: D # maj, as D # is 3 semitones above C.

$\tau_n$ is written for the transposition of n semitones. For instance, $\tau_{-2}$ is a transposition of two semitones (i.e., one tone) down, and $\tau_{+3}$ is a transposition of a three semitones (i.e., a minor third) up.

Transposing a musical signal is achieved with a certain loss in audio quality. The loss increases with the difference in frequency between the original and the target signal. Therefore, each transposition $\tau_s$ may be associated to a cost $c(\tau_s)$, which mostly depends on s. For instance, c(s)=|s| is used.

It is a common practice, especially in jazz, to use chord substitutions when improvizing. Substituting one chord to another is a way to increase variety and create novelty in a performance. The substituted chords have a common harmonic quality with the original chord, for instance, they may usually have several notes in common and the bass of the original chord usually belongs to the substituted chord. A substitution rule is an abstract operation that does not affect the audio content. Instead, it can be seen as a mere rewriting rule.

For instance, rule $\sigma_1$ (as shown in FIG. 12) states that when the chord progression requires a C7 chord, a G min 7 chord may be play instead. In more general, $\sigma_1$ states that any chord of type 7 may be substituted by a chord of type min 7 whose root is one fifth higher that of the original chord (as e.g. described in Pachet, F., Surprising Harmonies. International Journal of Computing Anticipatory Systems, 4, Feb. 1999.)

The rules are all written with a left part in C, i.e., the chord on the left has pitch class C as its root. This is a handy way of writing the rules. However, the rules apply to any root, not only C. In other words, each rule represents a set of 12 rules, one for each root for the left chord. The 12 rules can easily be found by transposing the right chord as shown in FIG. 13.

$\sigma_i(c)$ is written to represent the chord obtained by applying rule $\sigma_i$ to chord c. For instance $\sigma_1$(A7)=E min 7.

Each chord substitution creates an unexpected effect on the listener. The effect is more or less unexpected depending on the substitution rule applied, as some substitutions are more usual than others, and as some substituted chords share more harmonic qualities with the original chord than others. Each substitution rule $\sigma_i$ is associated to a cost $c(\sigma_i)$ that accounts for this.

A chord transformation is preferably the composition of a single chord substitution with a single chord transposition. Given any two chords $c_1=(r_1, t_1)$ and $c_2=(r_2, t_2)$, each transformation $\tau_j \circ \sigma_i$ from $c_1$ to $c_2$ has a cost $c(\tau_j)+c(\sigma_i)$.

A generalizing harmonization device generates accompaniments for a chord progression and from a database of pre-recorded bars, even if the database is not complete for the target chord progression. For the chords in the chord progression that have no corresponding bar in the database, the GHD uses chord transformations to generate contents to playback. The GHD uses selection algorithms to select the best transformations to apply for a given chord.

The substitution rule set is said to be complete with respect to the chord types if for any two chord types $t_1$ and $t_2$, there is a rule $\sigma_i$ whose left part is of type $t_1$ and whose right part is of type $t_2$. The substitution rule set shown in FIG. 12 is not complete as, for instance, chords of type 7 and maj7 are not substitutable. But other rules may be added to make it complete. If the substitution rule set is complete with respect to chord types, then the GHD is capable of playing a complete accompaniment for any chord progression. Otherwise, some chords in the progression may not be played on.

In the following three exemplary algorithms will be shown that provide primitives for building applications of the generalizing harmonization device. Algorithm 1 computes and returns the set consisting of the best transformations of a chord $C_1$ to another chord $C_2$, given a set $\Sigma$ of substitutions. In the algorithm, $r(C_i)$ denotes the root note of chord $C_i$ and $t(C_i)$ denotes its type.

Algorithm 1 The best transformation algorithm

```
procedure BESTTRANSFORMATIONS(C1, C2, Σ)
    S ← {σ ∈ Σ: t(σ(C1)) = t(C2)}
    B ← ∅
    c ← +∞
    for σ ∈ S do
        n ← |r(σ(C1)) − r(C1)|          ▷semitone count from roots of C1 and σ(C1)
        if c = c(σ) + c(τn) then
            B ← B ∪ {τn ∘ σ}
        if c > c(σ) + c(τn) then
            c ← c(σ) + c(τn)
            B ← {τn ∘ σ}
    return B
end procedure
```

Algorithm 2 uses Algorithm 1 and computes the minimum cost to transform a chord $C_1$ into a chord $C_2$.

Algorithm 2 The minimum transformation cost

```
procedure COSTTRANSFORMING(C1, C2, Σ)
    let τ ∘ σ ∈ BESTTRANSFORMATIONS(C1, C2, Σ)
    return c(τ ∘ σ)
end procedure
```

Algorithm 3 takes two inputs: 1) a target chord c and 2) a database $D=\{C_1, \ldots, C_n\}$ of pre-recorded bars. It computes the set consisting of all pairs $<C_1, \tau\circ\sigma>$ such that $C_i \in D$, $\tau\circ\sigma(C_i)=C$, and the cost $c(\tau\circ\sigma)$ is minimal.

Algorithm 3 Best transformations from D

```
procedure BESTTRANSFORMATIONSDB(D, C, Σ)
                ▷D = {D1, . . . , Dm} is the database
                ▷C is the target chord
                ▷Σ is the substitution rule set
    B ← ∅
    c ← +∞
    for i = 1, . . . , m do
        Bi ← BESTTRANSFORMATIONS(Di, C, Σ)
        ci ← COSTTRANSFORMING(Di, C, Σ)
        if c = ci then
            B ← B ∪ {⟨Di, τ ∘ σ⟩ : T ∘ S ∈ Bi}
        if c > ci then
            B ← {⟨<Di, τ ∘ σ⟩ : T ∘ S ∈ Bi}
            c ← ci
    return B
end procedure
```

The generalizing harmonization device may be used in different practical contexts. For instance, in some application contexts, a database of recorded chords is available before the improvisation starts. In other application contexts, the database may be recorded during the improvisation phase. These different contexts call for different strategies for the generation of an accompaniment by the generalizing harmonization device.

In the simplest case, a database of prerecorded chords is available and no constraint is set on transformation costs. In this case, a cost-optimal complete accompaniment may be generated with the following straightforward strategy: For each chord in the progression, play back one of the best chords available, using Algorithm 3 to determine the "best" chords. This strategy guarantees that the accompaniment minimizes the transformation cost at each bar. Algorithm 4 implements this strategy:

Algorithm 4 Best transformations from D

```
procedure PLAYBACKCOSTOPTIMAL(P, D, Σ)
                    ▷P = {C_1, . . . , C_n} is the chord progression
                        ▷D = {D_1, . . . , D_m} is the database
                            ▷Σ is the substitution rule set
  for i = 1, . . . , n do
      B ← BESTTRANSFORMATIONSDB(D, C_i, Σ)
      let ⟨D_i, τ ∘ σ⟩ ∈ B   ▷choose randomly
      playback τ(D_i)   ▷τ(D_i) is the actual acoustic transposition of D_i
end procedure
```

If a constraint is set on cost, e.g., the transformation cost cannot exceed a threshold, a complete accompaniment cannot necessarily be generated. Here is strategy that generates an exemplary accompaniment that is not complete, but guarantees that the transformation costs never exceed the threshold value. It consists in playing back one of the best available chords if the cost is below the cost threshold and to play nothing otherwise using Algorithm 5:

Algorithm 5 Best transformations from D with max-cost $c_{max}$

```
procedure PLAYBACKCOSTOPTIMAL(P, D, c_max)
                    ▷P = {C_1, . . . , C_n} is the chord progression
                        ▷D = {D_1, . . . , D_m} is the database
                ▷c_max is the maximum transformation cost allowed
                            ▷Σ is the substitution rule set
  for i = 1, . . . , n do
    B ← the BESTTRANSFORMATIONSDB(D, C_i, Σ)
    if B = ∅ then      ▷no bar can be transformed with cost ≤ c_max
        playback silence
    else
        let ⟨D_i, τ ∘ σ⟩ ∈ B      ▷choose randomly
        playback τ(D_i)▷τ(D_i) is the actual acoustic transposition of D_i
end procedure
```

Generalizing harmonization devices can be applied to reflexive loop pedals. In this case, it allows a reflexive loop pedal to be used in a much more flexible and entertaining way, by reducing the feeding phase by a considerable amount of time.

In the context of a reflexive loop pedal, a musician may improvize on a chord progression. The bars during which the musician plays chords may be recorded by the reflexive loop pedal to feed a database. The bars in the database may be played back by the reflexive loop pedal when the musician plays a solo melody (or bass) to provide a harmonic support, or accompaniment, to the solo. In this context, for a given bar in the chord progression, the loop pedal only plays an accompaniment if the database contains at least one bar with the corresponding harmonic structure. To ensure that a conventional loop pedal will provide a complete accompaniment, the musician must start by feeding the database with at least one chord for every harmonic structure present in the chord progression. This may create a sense of boredom for the musician as well as for the audience.

For instance, consider John Coltrane's Giant Steps, a chord progression that is particularly complex is shown in the table below.

| | | | | | | |
|---|---|---|---|---|---|---|
| B maj7 | D7 | G maj7 | B♭7 | E♭ maj7 | A min 7 | D7 |
| G maj7 | B♭7 | E♭ maj7 | F♯7 | B maj7 | F min 7 | B♭7 |
| E♭ maj7 | | A min 7 | D7 | G maj7 | C♯ min 7 | F♯7 |
| B maj7 | | F min 7 | B♭7 | E♭ maj7 | C♯ min 7 | F♯7 |

Giant Steps is a 16-bar progression with 9 different chords: B maj7, D7, G maj7, Bb7, Eb maj7, A min 7, F #7, F min 7, and C # min 7. Moreover, almost each bar has a unique harmonic structure in this tune. Therefore, to ensure a complete accompaniment on Giant Steps, the musician has to play chords during most of the bars of one whole execution of the chord progression. It will now be shown that a GHD according to the present disclosure may allow the feeding phase to be dramatically reduced.

In the context of a reflexive loop pedal, more complex accompaniment strategies may be implemented, as the musician has to follow the chord sequence defined by the tune from left to right. Consider the chord progression $P_{GS}$ shown in the above table. The musician starts improvizing on this chord progression with an empty database $D_{GS}$. Here is a scenario that allows the musician to get a complete accompaniment from the GHD:

- The musician plays a chord $C_1$ on the first chord of the progression B maj7. This chord is recorded in the database D.
- There is no substitution in $\Sigma_{ref}$ that substitutes a maj7-type chord to a 7-type chord. Therefore, there is no transformation that transforms the only recorded chard $C_1$ into $D_7$. Therefore, the musician has to play a chord $C_2$ during the second half of the first bar (corresponding to $D_7$). $C_2$ is also recorded in the database.
- The two chords of the second bar of $P_{GS}$ are mere transpositions of the chords of the first bar by a descending major third. Therefore, chords $C_1$ and C2 can be played back by the GHD after applying $\tau_{-4}$. The cost is therefore 4 for each chord of bar 2.
- On bar 3, Eb maj7 is obtained by applying $\tau_{+4}$ to $C_1$. The cost is 4.
- A min 7 on bar 4 is a substitution of G maj7 by rule $\sigma_{25}$, itself obtained as a transposition of $C_1$ by $\tau_{-4}$. Therefore, the GHD will play back $\tau_{-4} \circ \sigma_{25}$ ($C_1$). The cost is 4+1=5.
- D7 on bar 4 is $C_2$.
- Bar 5 is identical to bar 2.
- It is easy to see that the rest of the chord progression can be obtained from $C_1$ and $C_2$.

In the scenario above, only two chords, $C_1$ and $C_2$, were played to ensure that the GHD plays a complete accompaniment. This scenario however, does not make any restriction on the transformation costs. If the transformation cost is limited to say 4, chord A min 7 on bar 4 can no longer be obtained by $\tau_{-4} \circ \sigma_{25}(C_1)$ whose cost is 5. A least expensive transformation is $\sigma_{23}$:$\sigma_{23}$:C min 7→F7, is equivalent to A min 7→D7 after changing the roots. Therefore, the GHD can play $C_2$ during the first half of bar 4. The corresponding cost is $c(\sigma_{23})=1$.

The example and scenario above raise a question: given a maximum cost $c_{max}$ ad a chord progression, what is the strategy that minimizes the number of chords that have to be played by the musician in order to guarantee a complete accompaniment using only transformation with costs under $c_{max}$? This is actually a complex combinatorial (e.g. NP-hard, as known to computer scientists) problem, proven equivalent to a general set covering, which cannot be in reasonable time by any known algorithm (unless P=NP).

It is therefore proposed to follow a greedy approach to find a sub-optimal solution in real-time. Algorithm 6 computes a sequence of indices. Each index is the position of a chord in the target chord progression. It is sufficient that the musician plays chords at every specified position to ensure that the GHD will perform a complete accompaniment.

Algorithm 6 Greedy algorithm to find sub-optimal improvization strategy

```
procedure PLAYBACKCOSTOPTIMAL(P, D, c_max, Σ)
                    ▷ P = {C_1, . . . ,C_n} is the chord progression
                    ▷ D = {D_1, . . . , D_m} is the database
                    ▷ c_max is the maximum transformation cost allowed
                    ▷ Σ is the substitution rule set
    C = ∅
    for i = 1, . . . , n do
        B ← BESTTRANSFORMATIONSDB(D, C_i, Σ)
        if B = ∅ then
            C ← C ∪ {i}
        let c = c(τ ∘ σ) for some τ ∘ σ ∈ B
        if c > c_max then
            C ← C ∪ {i}
    return C
end procedure
```

However, some better strategies, i.e., using less chords, could be obtained by a complete search based on any backtracking algorithm. The greedy algorithm, applied to $P_{GS}$ with $c_{max}$=3 yields the sequence (1, 2, 3, 5). The following table shows the corresponding execution, with the transformations used and their respective cost. The musician has to play chords, say $c_1$, $c_2$, $c_3$, and $c_4$ (indicated in bold in the table) on positions 1, 2, 3 and 5 in the chord progression, i.e., B maj7, D7, G maj7, and Eb maj7. Transformations of $c_1$, $c_2$, $c_3$, and $c_4$ are then used by the GHD to play chords on the rest of the progression. The musician can therefore play a solo melody on top of the accompaniment. The feeding phase is reduced to two and a half bar.

| | | | | | | |
|---|---|---|---|---|---|---|
| $c_1$: B maj7 | $c_2$: D7 | $c_3$: G maj7 | $\tau_2 \circ \sigma_2(c_2)$ | $c_4$: E♭ maj7 | $\sigma_1(c_2)$ | $c_2$ |
| $c_3$ | $\tau_2 \circ \sigma_2(c_2)$ | $c_4$ | $\tau_{-2} \circ \sigma_2(c_2)$ | $c_1$ | $\tau_1 \circ \sigma_1(c_3)$ | $\tau_2 \circ \sigma_2(c_2)$ |
| | $c_4$ | $\sigma_1(c_2)$ | $c_2$ | $c_3$ | $\tau_1 \circ \sigma_1(c_4)$ | $\tau_{-2} \circ \sigma_2(c_2)$ |
| | $c_1$ | $\tau_1 \circ \sigma_1(c_3)$ | $\tau_2 \circ \sigma_2(c_2)$ | $c_4$ | $\tau_1 \circ \sigma_1(c_4)$ | $\tau_{-2} \circ \sigma_2(c_2)$ |

The greedy algorithm, applied to $P_{GS}$ with $c_{max}$=4, yields the sequence (1, 2). The following table shows the corresponding execution, with the transformations used and their respective cost. The musician has to play chords, say $c_1$ and $c_2$, on the first two positions in the chord progression, i.e., B maj7 and D7. Transformations of $c_1$ and $c_2$ are then used by the GHD to play/generate chords on the rest of the progression. The musician can therefore play a solo melody on top of the accompaniment. The feeding phase is reduced to one bar.

| | | | | | | |
|---|---|---|---|---|---|---|
| $c_1$: B maj7 | $c_2$: D7 | $\tau_{-4}(c_1)$ | $\tau_2 \circ \sigma_2(c_2)$ | $\tau_4(c_1)$ | $\sigma_1(c_2)$ | $c_2$ |
| $\tau_{-4}(c_1)$ | $\tau_2 \circ \sigma_2(c_2)$ | $\tau_4(c_1)$ | $\tau_{-2} \circ \sigma_2(c_2)$ | $c_1$ | $\tau_{-3} \circ \sigma_1(c_1)$ | $\tau_2 \circ \sigma_2(c_2)$ |
| | $\tau_4(c_1)$ | $\sigma_1(c_2)$ | $c_2$ | $\tau_{-4}(c_1)$ | $\tau_{-2} \circ \sigma_1(c_1)$ | $\tau_{-2} \circ \sigma_2(c_2)$ |
| | $c_1$ | $\tau_{-3} \circ \sigma_1(c_1)$ | $\tau_2 \circ \sigma_2(c_2)$ | $\tau_4(c_1)$ | $\tau_{-2} \circ \sigma_1(c_1)$ | $\tau_{-2} \circ \sigma_2(c_2)$ |

In summary, the present disclosure describes a simple device and method that preferably uses audio transformations and/or musical chord substitution rules to perform rich harmonization and/or music real-time accompaniments from incomplete audio material. Real-time in this context is not limited to situations in which the chord(s) is (are) being played live by the musician, but may alternatively be played in a feeding phase for providing a few prerecorded bars. Some or all of the transformations may already be calculated in advance as well, and the actual "real-time" accompaniment of the musician is actually be performed at a later time, based on the pre-recorded chord(s) Further, situations in which the system may be able to start accompaniment after having received only a few bars, so that there would still be a delay of the few bars, shall be understood to be covered by the disclosed real-time accompaniments.

Obviously, numerous modifications and variations of the present disclosure are possible in light of the above teachings. It is therefore to be that within the scope of the appended claims, the disclosure may be practiced otherwise than as specifically described herein.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

In so far as embodiments of the disclosure have been described as being implemented, at least in part, by software-controlled data processing apparatus, it will be appreciated that a non-transitory machine-readable medium carrying such software, such as an optical disk, a magnetic disk, semiconductor memory or the like, is also considered to represent an embodiment of the present disclosure. Further, such software may also be distributed in other forms, such as via the Internet or other wired or wireless telecommunication systems.

The elements of the disclosed devices, apparatus and systems may be implemented by corresponding hardware and/or software elements, for instance appropriated circuits. A circuit is a structural assemblage of electronic components including conventional circuit elements, integrated circuits including application specific integrated circuits, standard integrated circuits, application specific standard products, and field programmable gate arrays. Further a circuit includes central processing units, graphics processing units, and microprocessors which are programmed or configured according to software code. A circuit does not include pure software, although a circuit includes the above-described hardware executing software.

Any reference signs in the claims should not be construed as limiting the scope.

The invention claimed is:

1. A device for generating a real time music accompaniment, said device comprising:

circuitry configured to receive pieces of music played by a musician, classify the pieces of music into one of at least three different music modes, said at least three different music modes including at least a solo mode, a bass mode and a harmony mode, calculate a chord transformation cost, the chord transformation cost being a sum $c(\tau_j)+c(\sigma_i)$ of a chord transposition cost $c(\tau_j)$ due to transpositions between one or more recorded pieces of music and the received pieces of music and a chord substitution cost $c(\sigma_i)$ due to substitutions between the one or more recorded pieces of music and the received pieces of music, wherein the chord transposition cost $c(\tau_j)$ is calculated based on a number of semitones down or up from the received pieces of music to the one or more recorded pieces of music, the chord transposition cost $c(\tau_j)$ increasing as the number of the semitones increases, and the chord substitution cost $c(\sigma_i)$ is calculated based on predetermined rules for chord substitution, each of the predetermined rules having each cost such that a first predetermined rule having more harmonic quality has lower cost than a second predetermined rule having less harmonic quality, select one or more recorded pieces of music having the chord transformation cost under a predetermined maximum chord transformation cost as real time music accompaniment to an actually played piece of music, wherein said one or more selected pieces of music are selected to be in a different one of said at least three music modes than the actually played piece of music, and output the one or more selected pieces of music.

2. The device as claimed in claim 1, wherein the circuitry is further configured to analyze a received piece of music to obtain a music piece description comprising one or more characteristics of the analyzed piece of music, and wherein said circuitry is configured to take a music piece description of an actually played piece of music and of recorded pieces of music into account in the selection of one or more recorded pieces of music as real time music accompaniment.

3. The device as claimed in claim 2, wherein said circuitry is configured to record said music piece description along with the corresponding piece of music.

4. The device as claimed in claim 2, wherein said circuitry is configured to obtain a music piece description comprising one or more of pitch, bar, key, tempo, distribution of energy, average energy, peaks of energy, number of peaks, spectral centroid, energy level, style, chords, volume, density of notes, number of notes, mean pitch, mean interval, highest pitch, lowest pitch, pitch variety, harmony duration, melody duration, interval duration, chord symbols, scales, chord extensions, relative roots, zone, type of instrument(s) and tune of an analyzed piece of music.

5. The device as claimed in claim 2, wherein the circuitry is further configured to receive or select a chord grid comprising a plurality of chords, wherein said circuitry is configured to obtain a music piece description comprising at least chords of beats of the analyzed piece of music, and wherein said circuitry is configured to take the chord grid of an actually played piece of music and the music piece description of recorded pieces of music into account in the selection of one or more recorded pieces of music as real time music accompaniment.

6. The device as claimed in claim 1, wherein the circuitry is further configured to receive or select a tempo of played music, and take the received or selected tempo of an actually played piece of music into account in the selection of one or more recorded pieces of music as real time music accompaniment.

7. The device as claimed in claim 1, wherein the circuitry is further configured to control said device to switch between recording and playback.

8. A method for generating a real time music accompaniment, said method comprising:

receiving, using circuitry, pieces of music played by a musician, classifying, using the circuitry, the received pieces of music into one of at least three different music modes, said at least three different music modes including at least a solo mode, a bass mode and a harmony mode, calculating, using the circuitry, a chord transformation cost, the chord transformation cost being a sum $c(\tau_j)+c(\sigma_i)$ of a chord transposition cost $c(\tau_j)$ due to transpositions between the one or more recorded pieces of music and the received pieces of music and a chord substitution cost $c(\sigma_i)$ due to substitutions between the one or more recorded pieces of music and the received pieces of music, wherein the chord transposition cost $c(\tau_j)$ is calculated based on a number of semitones down or up from the received pieces of music to the one or more recorded pieces of music, the chord transposition cost $c(\tau_j)$ increasing as the number of the semitones increases, and the chord substitution cost $c(\sigma_i)$ is calculated based on predetermined rules for chord substitution, each of the predetermined rules having each cost such that a first predetermined rule having more harmonic quality has lower cost than a second predetermined rule having less harmonic quality, selecting, using the circuitry, one or more recorded pieces of music having the chord transformation cost under a predetermined maximum chord transformation cost as real time music accompaniment to an actually played piece of music, wherein said one or more selected pieces of music are selected to be in a different one of said at least three music modes than the actually played piece of music, and outputting, using the circuitry, the selected pieces of music.

9. A non-transitory computer-readable recording medium that stores therein a computer program product, which, when executed by a processor, causes the method according to claim 8, to be performed.

10. The device as claimed in claim 1, wherein the circuitry is configured to perform the substitutions based on a list of substitutions.

* * * * *